US011608731B2

(12) United States Patent
Tian et al.

(10) Patent No.: US 11,608,731 B2
(45) Date of Patent: Mar. 21, 2023

(54) MECHANICAL AUTOMATIC VERTICAL DRILLING TOOL

(71) Applicants: Southwest Petroleum University, Chengdu (CN); Sichuan Jutingzao Technology Co., Ltd., Chengdu (CN)

(72) Inventors: Jialin Tian, Chengdu (CN); Tongxu Ge, Chengdu (CN); Zhichao Hu, Chengdu (CN); Lin Yang, Chengdu (CN); Chunyu Xing, Chengdu (CN); Lei Tang, Chengdu (CN)

(73) Assignees: Southwest Petroleum University, Chengdu (CN); Sichuan Jutingzao Technology Co., Ltd., Chengdu (CN)

( * ) Notice: Subject to any disclaimer, the term of this patent is extended or adjusted under 35 U.S.C. 154(b) by 24 days.

(21) Appl. No.: 17/335,847

(22) Filed: Jun. 1, 2021

(65) Prior Publication Data

US 2022/0186599 A1 Jun. 16, 2022

(30) Foreign Application Priority Data

Dec. 10, 2020 (CN) ..... 202011454301.3

(51) Int. Cl.

| | |
|---|---|
| ***E21B 44/00*** | (2006.01) |
| ***E21B 41/00*** | (2006.01) |
| ***E21B 7/04*** | (2006.01) |
| ***E21B 47/024*** | (2006.01) |

(52) U.S. Cl.

CPC ..... *E21B 44/005* (2013.01); *E21B 7/04* (2013.01); *E21B 41/0078* (2013.01); *E21B 47/024* (2013.01)

(58) Field of Classification Search

CPC ..... E21B 44/005; E21B 7/04; E21B 41/0078; E21B 47/024; E21B 7/06; E21B 47/12

See application file for complete search history.

(56) References Cited

U.S. PATENT DOCUMENTS

| | | | | |
|---|---|---|---|---|
| 2013/0319764 | A1* | 12/2013 | Schaaf | E21B 7/068 175/50 |
| 2019/0169935 | A1* | 6/2019 | Spatz | E21B 10/42 |
| 2020/0318437 | A1* | 10/2020 | Gray | E21B 17/1014 |
| 2020/0408085 | A1* | 12/2020 | Lloyd | E21B 47/0228 |

* cited by examiner

*Primary Examiner* — D. Andrews
*Assistant Examiner* — Yanick A Akaragwe
(74) *Attorney, Agent, or Firm* — Andrew D. Fortney; Central California IP Group, P.C.

(57) ABSTRACT

A mechanical automatic vertical drilling tool, with ends that are connected with an upper drilling tool and a bit by a detachable thread, is disclosed. The tool comprises a control device, an actuator and an auxiliary part. The control device detects status of wellbore and controls operations of the actuator when the wellbore leans. The actuator pushes a block out against the well wall to generate a radial force, which pushes against the drill bit to prevent deviation and modify the wellbore trajectory. The auxiliary part transmits the indispensable bit pressure and torque for drilling to assist the control device and the actuator to achieve the function. This disclosure can get automatic deviation correction with only mechanical structures. It is simple and reliable, and unlikely to fail in complicated wells without any manual operation.

10 Claims, 4 Drawing Sheets

A-A

B-B

MECHANICAL AUTOMATIC VERTICAL DRILLING TOOL

TECHNICAL FIELD

The disclosure relates generally to the technical field of oil drilling, more particularly to a mechanical automatic vertical drilling tool.

BACKGROUND

In the process of drilling oil and gas wells, with the depth of drilling increasing, geological factors such as higher rock hardness, more uneven distribution of hard and soft rock layers, and worse drilling ability of the formation can cause significant problems for oil and gas drilling. Borehole deviation will occur while the hard rock with the uneven coarse grains is encountered in the vertical section of the directional well, the influence of borehole angle and ROP (rate of penetration) on drilling efficiency is more significant with the increase of geological depth and drilling difficulty. Existing deviation correcting drilling systems are expensive and unreliable due to the presence of electronic equipment.

Thus, how to realize fast drilling with deviation correction in high-steep and high-slope formation is a technical problem eager to be solved in this field.

SUMMARY OF THE INVENTION

A mechanical automatic vertical drilling tool with a purely mechanical structure and automatic operation for drilling vertical wells is disclosed.

A mechanical automatic vertical drilling tool comprises a test member, a mandrel, a control device, an actuator, a main body, an auxiliary part and first and second ends, the first end being connectable with an upper drilling tool by a first detachable screw thread and the second end being connectable with a bit with a second detachable screw thread.

The test member, functions as an upper connector of the mechanical automatic vertical drilling tool, is configured to test an azimuth angle, a tool face angle, a well inclination angle, etc., and transmits relevant test data to the operator at the same time. The test member has an inner part connected with the mandrel by a screw thread.

The control device comprises an eccentric block switch inside of an upper shell, and a plane bearing and a centralizing bearing configured to limit the axial and radial movement of the eccentric block switch. The control device is configured to automatically detect and control an operation of the actuator.

The actuator includes a plurality of unidirectional nozzles, a plurality of first pushing blocks and second pushing blocks each having a clearance fit of the main body, and pushing block screws on the plurality of first pushing blocks. And the actuator is configured to generate radial force against the drill bit to correct a deviation when the drilling tool is tilted.

The auxiliary part comprises a lower connector that is connectable with the drill bit, string bearings that withstand an axial force of the control device, and a TC bearing that withstands the radial force.

In some embodiments, the eccentric block switch comprises an eccentric block and a switch, is in an upper shell supported by the plane bearing and the centralizing bearing, and is configured to rotate freely relative to the mandrel and the upper shell.

In some other embodiments, the eccentric block has one side relative to a centerline of the eccentric block switch that is a half cylinder, but another side that is at least partially removed, so that the two sides are asymmetric. The eccentric block has upper and lower ends respectively configured with shoulders for assembling the centralizing bearings and the plane bearings. The switch is configured with a hole C and a hole D on the opposite sides of the complete half cylinder. The angle between the hole C and the hole D is 100°, grooves around the hole C and hole D for a sealing ring are on an outer surface of the switch.

In other embodiments, the pushing blocks A and pushing blocks B both configured with the unidirectional nozzles each have a 'C' shape. The main body matches with a clearance fit some in an internal portion of the pushing blocks A and an internal portion of pushing block B, and the other internal portions of the pushing blocks A are matched with clearance fit the other external portions of the pushing block B.

In some further embodiments, the pushing blocks A are configured with six pushing block screws and the pushing blocks B are configured with six corresponding screws grooves. Wherein, the pushing block screws fit with the grooves to limit the radial expansion and contraction of the pushing blocks A and pushing block B.

Furthermore, the pushing blocks A and pushing block B are radially distributed in two layers in the axial direction of the main body, horizontally perpendicular to each other.

In other embodiments, the unidirectional nozzles each have a shell that is connected with the pushing blocks A or the pushing block B. The nozzle shell has (i) an internal portion a screw threaded connection mechanism and (ii) a nozzle inner baffle, the internal portion of the nozzle shell is connected to the inner baffle and another portion of the shell comprises an internal spline groove. The unidirectional nozzles each have a valve with a spool having an outer diameter. The shell has a minimum inner diameter identical to an outer diameter of the nozzle valve. The inner baffle has an inner hexagonal through hole with an inner diameter that is less than the outer diameter of the valve spool.

In some embodiments, the main body is connected with the upper shell and is configured with two layers of cavities in the radial direction for assembling the pushing blocks A and pushing block B. The surface of the main body opposite to the unidirectional nozzle is configured with symmetrically distributed holes E. The axes of the holes E on one layer are perpendicular to others on the other layer.

Further, the mandrel has holes A and holes B; each of the holes A and the holes B has an axis, and at least one of the holes A and B corresponds to the holes E on the main body. The mandrel has an outer surface configured with annular grooves near the holes A and holes B. The mandrel has upper and lower ends respectively connected with the test member and the lower connector by threaded connectors.

In further embodiments, the TC bearings are located near the string bearings. The mandrel is connected to a TC bearing moving-ring, and the upper shell or the main body is connected to a TC bearing static ring. The TC bearing moving-ring and the TC bearing static ring limit an axial displacement of a string bearing inner ring connected with the mandrel and a string bearing outer ring connected with the upper shell and the main body, respectively. A retaining ring A of the string bearing simultaneously limits an axial position of the string bearing outer ring and an outer ring of the centralizing bearing.

The invention has below beneficial effects: it is a purely mechanical tool to control and execute the tilt correction, unlikely to fail in various complicated and changeable environments. When the well bore leans, the mechanical automatic vertical drilling tool can automatically correct itself, without extra human operation. And it is stable, reliable and low cost, without any electrical devices in it.

BRIEF DESCRIPTION OF THE DRAWINGS

Features and advantages of the invention will be apparent from the detailed description which follows, taken in conjunction with the accompanying drawings, wherein.

The same parts are marked with the same reference number in the drawings, which are only used to illustrate the principle of the embodiments and the drawings are not drawn to actual scale.

Figure 1:
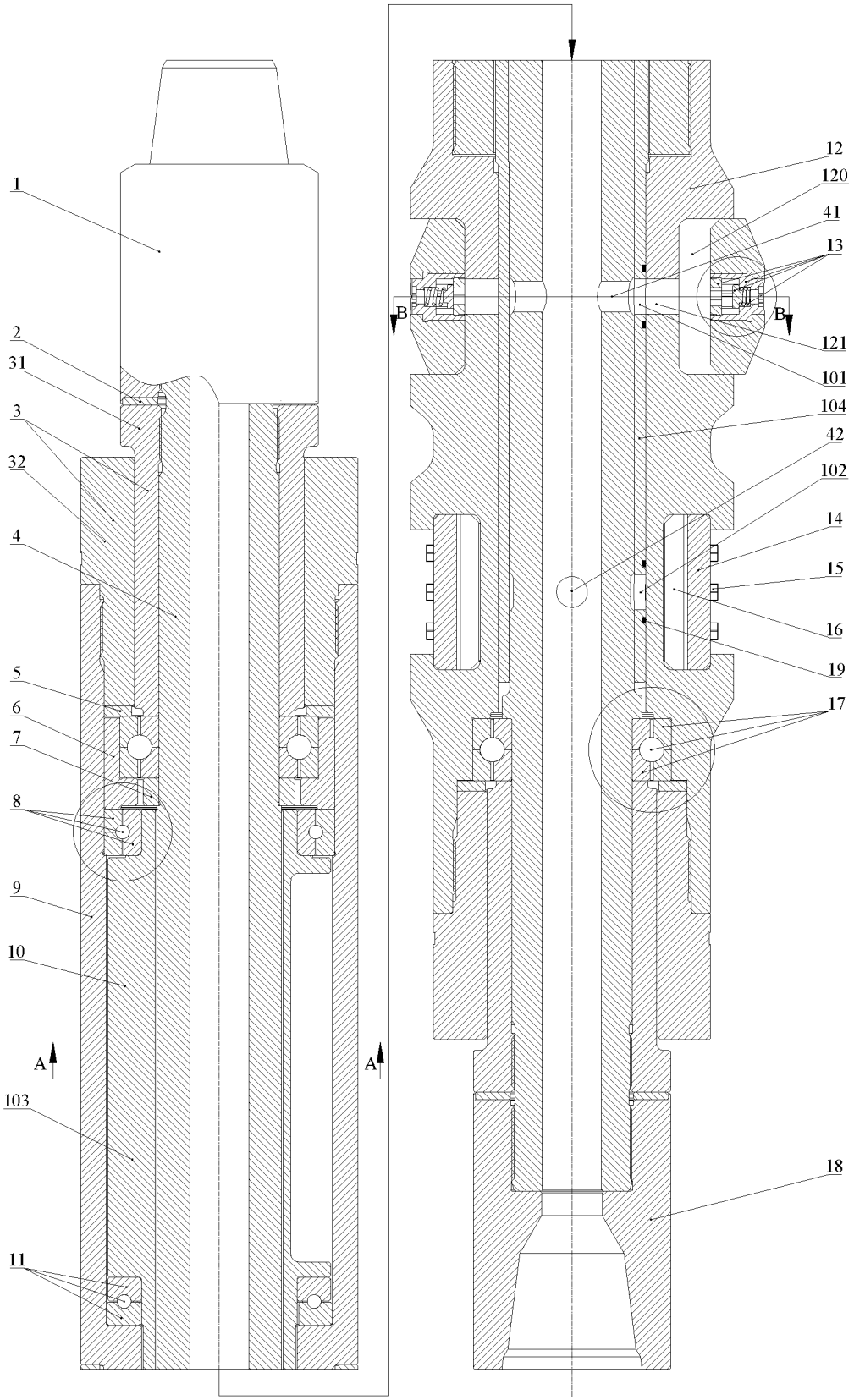
FIG. 1 illustrates an embodiment of a mechanical automatic vertical drilling tool.
Figure 2:
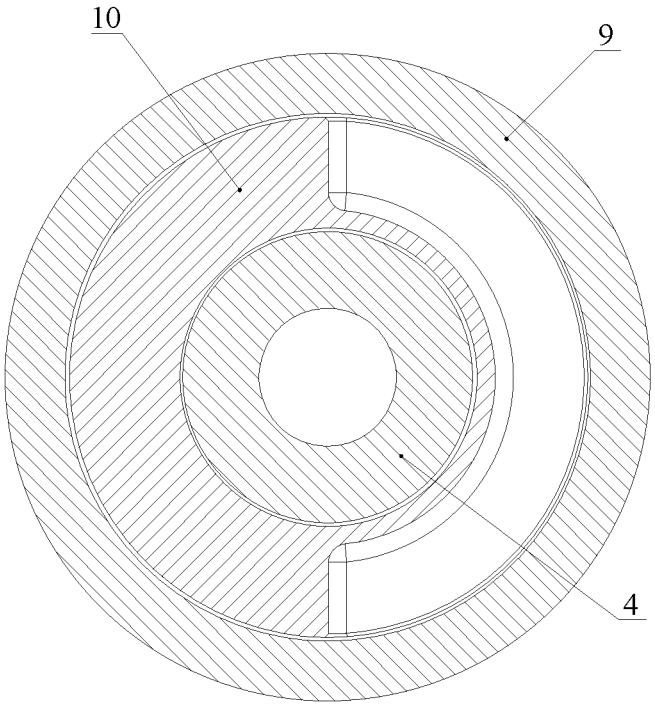
FIG. 2 illustrates a cross-section view of the control device in FIG. 1 along the line A-A.

The parts of the reference numbers in the drawings are as follows: 1—test member, 2—TC bearing washer, 3—TC bearing, 31—TC bearing moving—ring, 32—TC bearing static ring, 4—mandrel, 41—hole A, 42—hole B, 410—annular groove, 5—spacer, 6—string bearing retaining ring A, 7—string bearing retaining ring B, 8—centralizing bearing, 81—centralizing bearing outer ring, 82—ball A, 83—centralizing bearing inner ring, 9—upper shell, 10—eccentric block switch, 101—hole C, 102—hole D, 103—eccentric block, 104—switch, 11—plane bearing, 111—plane bearing upper retainer, 112—ball B, 113—plane bearing lower retainer, 12—the main body, 120—cavity, 121—hole E, 13—unidirectional nozzle, 131—nozzle inner baffle, 132—nozzle shell, 133—nozzle spool, 134—nozzle spring, 14—pushing block A, 15—pushing block screw, 16—pushing block B, 161—groove, 17—string bearing, 171—string bearing outer ring, 172—ball C, 173—string bearing inner ring, 18—lower connector, 19—sealing ring.

DETAILED DESCRIPTION OF THE INVENTION

The invention will be further illustrated in combination with the drawings.

FIG. 1 illustrates an exemplary embodiment of the mechanical automatic vertical drilling tool disclosed in present invention. It is understood that: the mechanical automatic vertical drilling tool can be used in a variety of drilling situations where vertical wells need to be guaranteed. The drawings show the tool applied in oil drilling, but not limit to this. The following example is the tool applied in oil drilling.

As illustrated in FIG. 1, the mechanical automatic vertical drilling tool comprises a test member 1 configured to be an upper connector of the mechanical automatic vertical drilling tool, an actuator, a control device to detect and control the operation of the actuator, and an auxiliary part. The inner part of the test member 1 is connected with a mandrel 4 by a threaded connector. The test member 1 are configured to test the azimuth angle, the tool face angle, the well inclination angle and so on, and to transmit the relevant test data to the operator at the same time. The actuator can generate a lateral force to push against the bit to correct the deviation while the tool is tilted. The auxiliary part is configured to transfer the necessary pressure and the torque for drilling and to assist the control device and the actuator.

In some embodiments, the mechanical automatic vertical drilling tool is connected with the upper drilling tool by the test member 1 and with the bit by the lower connector 18. The drilling fluid passes through the tool test member 1 into the tool via the mandrel 4. Most of the drilling fluid goes to the bit via mandrel 4 and lower connector 18. Since the eccentric block 103 of the eccentric block switch 10 is configured with asymmetric sides, a half cylinder side and a half removed side, when the tool tilts, the eccentric block switch 10 deflects due to its gravity and the holes C101 and D102 rotate to the higher side of the wellbore to connect the annular groove 410 on the external cylinder surface of the mandrel 4 and the hole E121 on the main body 12. At the same time, the eccentric block switch 10 closes the fluid channel on the lower side of the tool, and partial drilling fluid flows from the mandrel 4 into the cavities 120, then forces the pushing blocks A14 or the pushing blocks B16 to extend out against the well wall to generate a reaction force on the bit from the well wall to achieve deviation correction.

In another embodiment as shown in FIG. 1 to FIG. 5, the eccentric block switch 10 supported in the upper shell 9 by the plane bearing 11 and the centralizing bearing 8 is divided into the eccentric block 103 and the switch 104, which can rotate freely relative to the mandrel 4 and the upper shell 9, while the deflection of the eccentric switch 10 is only related to its gravity.

Furthermore, the eccentric block 103 of the eccentric block switch 10 is configured with asymmetric sides, a complete half cylinder side, and another half-removed side. The asymmetric structure makes the eccentric block switch 10 having an eccentric effect and can deflect due to its gravity. Both ends of the eccentric block 103 are configured with shoulders to assemble a centralizing bearing 8 and a plane bearing 11. The switch 104 is configured with a hole C 101 and hole D 102 on the half-removed side of the eccentric block 103. Preferably, the circumferential size of the hole C 101 and the hole D 102 is greater than 90° but less than 180° of the circumference of the eccentric block switch 10 to ensure that the tool has a correction function in the 360° direction. When the higher side of the wellbore is between the pushing blocks A 14 or the pushing blocks B 16 perpendicular to each other on horizontal surface, two layers of pushing blocks A 14 or B 16 on both sides of the wellbore extend out at the same time and push against the borehole wall and generate a reaction force to push back against the bit to achieve deviation correction. Around the holes C 101 and D 102, the external cylindrical surface of the switch 104 is configured with a groove 410 for a sealing ring 19 to completely block the annular groove 410 on the external surface of the mandrel 4 and the holes E121 on the main body 12 after the holes C 101 and holes D 102 rotate away.

Figure 3:
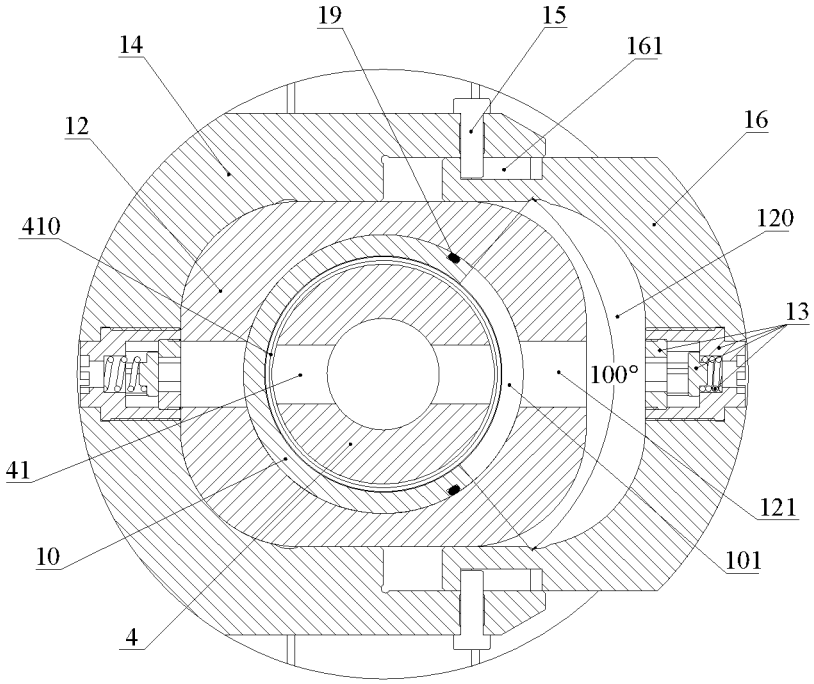
FIG. 3 illustrates a cross-sectional view of the actuator in FIG. 1 along the line B-B.
Figure 4:
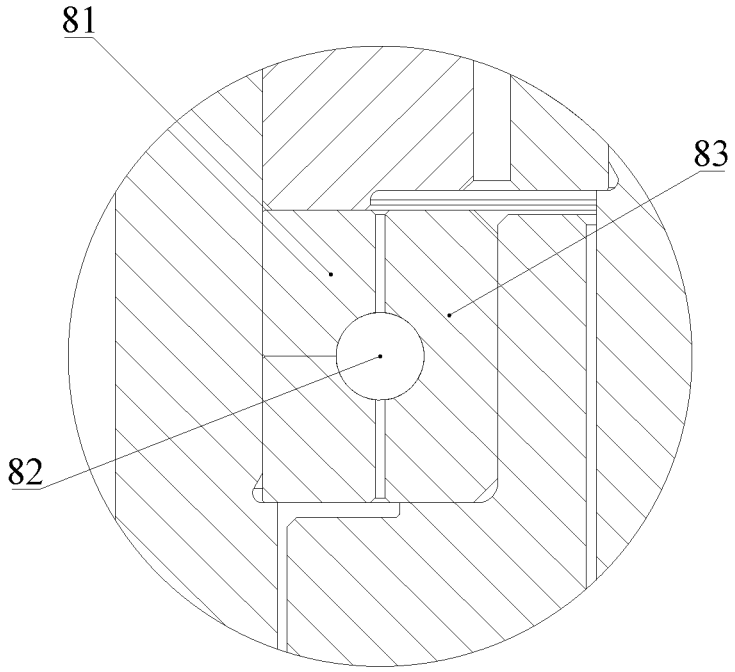
FIG. 4 illustrates an enlarged structure of the centralizing bearing in FIG. 1.
Figure 5:
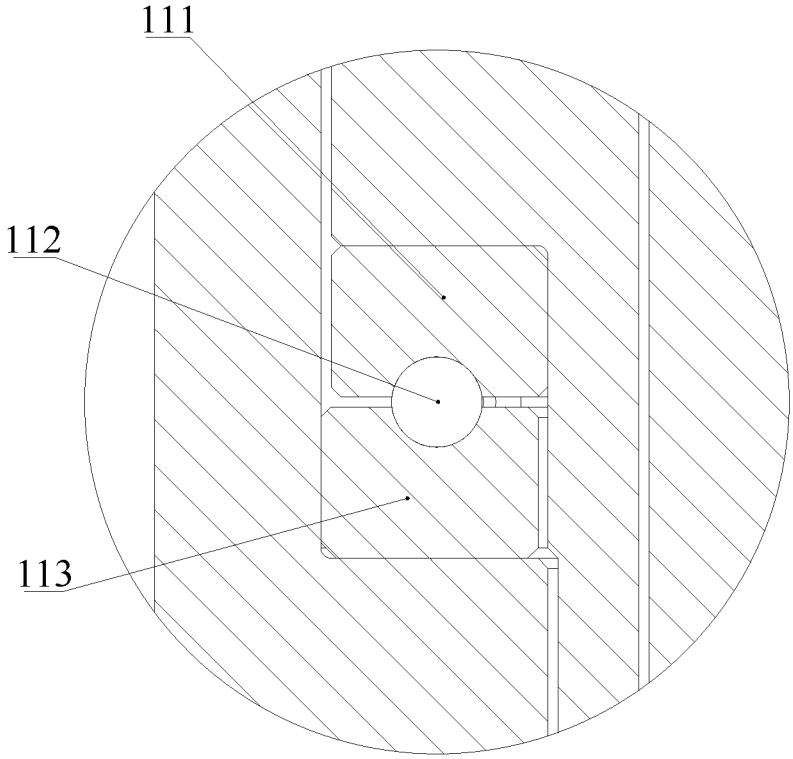
FIG. 5 illustrates an enlarged structure of the plane bearing in FIG. 1.
Figure 6:
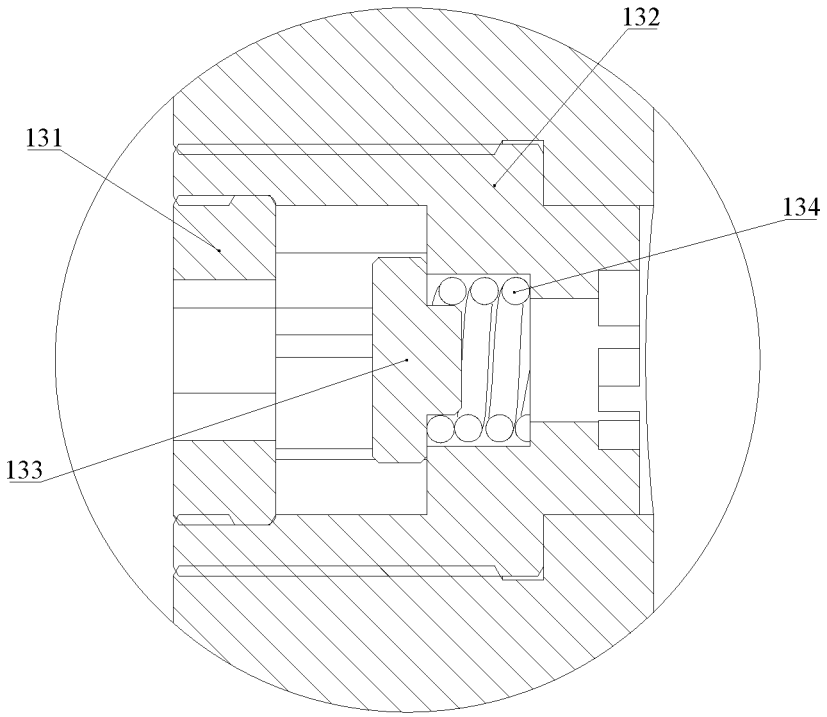
FIG. 6 illustrates an enlarged nozzle structure in FIG. 1.

In a preferred embodiment in FIG. 1, FIG. 3 and FIG. 6, the structure of the pushing blocks A14 and the pushing blocks B16 are 'C' shaped. Internal segments of the pushing blocks A 14 are configured to be in the clearance fit with the main body 12 and the external segments of the pushing block B 16. The pushing blocks B 16 are in the clearance fit of main body 12. The pushing blocks A 14 and the pushing blocks B 16 are configured with the unidirectional nozzles 13.

In some further embodiments, pushing blocks A 14 and pushing blocks B 16 are configured with six pushing block screws 15 and six grooves 161, respectively and correspondingly. The push block screws 15 fit with the grooves 161 to limit the radial expansion and contraction of the pushing blocks A 14 and the pushing blocks B 16.

Furthermore, the pushing blocks A 14 and pushing blocks B 16 are distributed in two layers in the axial direction of the main body 12, and horizontally perpendicular to each other in two layers.

In some embodiments, a unidirectional nozzle 13 is connected with the pushing block A 14 or the pushing block B 16 by an external threaded connector of the nozzle shell 132. Part of the internal surface of nozzle shell 132 is configured with a screw thread to match the nozzle inner baffle 131, and the other partial internal surface of the nozzle shell 132 is configured with internal spline grooves. The minimum inner diameter of nozzle shell 132 is identical to the outer diameter of the nozzle valve 133. The nozzle inner baffle is configured with a screw thread on its external surface and an inner hexagonal through hole in its middle to pass drilling fluid and assemble the nozzle inner baffle 131. The through hole has an inner diameter smaller than the outer diameter of the nozzle valve 133. The unidirectional nozzle 13 only allows fluid to flow out of the cavity A120. When the hole C 101 and hole D 102 rotate away, the channel between the cavity 120 and the wellbore annulus is communicated to relieve pressure resulting that the pushing blocks A14 or the pushing blocks B16 can be retracted into the cavity A120 by the reaction force of the well wall.

In some further embodiments, the main body 12 is configured with two cavities A120 for the pushing blocks A 14 and the pushing blocks B 16. The surface of the main body 12 connected with the upper shell 9 by a screw thread is configured with the symmetrical holes E 121 opposite to the unidirectional nozzles 13. The axes of the holes E 121 on the two layers are horizontally perpendicular to each other.

In a preferred embodiment shown in FIG. 1, the mandrel 4 is configured with the symmetrical holes A 41 and holes B 42 for fluid entering the cavity 120, and the axes of the holes A 41 and the holes B 42 corresponding to the symmetrical holes E 121 on the main body 12 in axial direction of the mandrel 4 are horizontally perpendicular to each other. The outer cylinder surface of the mandrel 4 is provided with annular grooves 410 at the position of holes A 41 and holes B 42. The upper and lower ends of the mandrel 4 are connected with the test member 1 and the lower connector 18 by a threaded connector, respectively.

Figure 7:
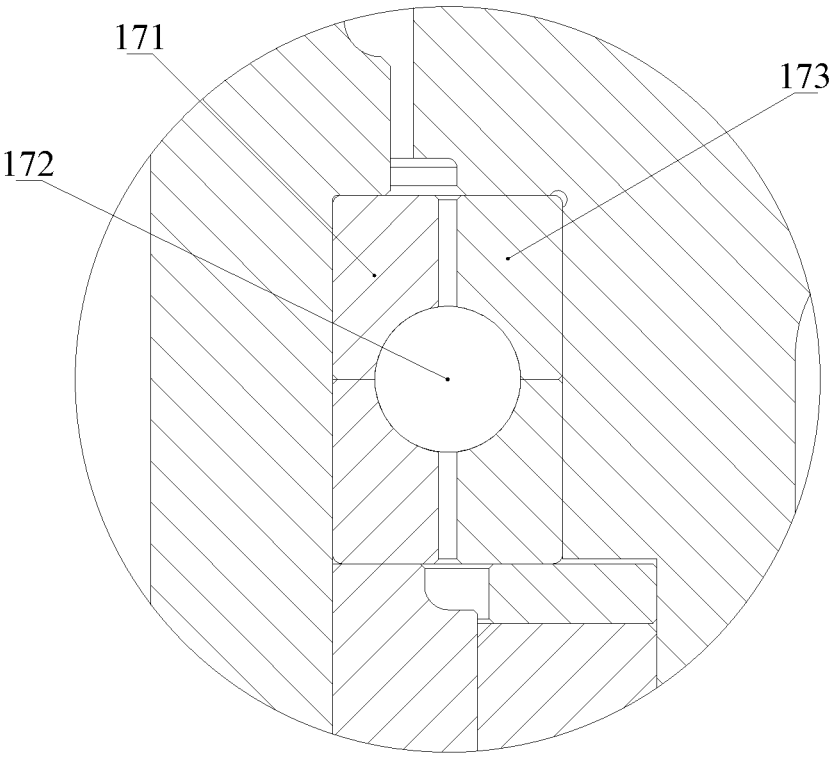
FIG. 7 illustrates an enlarged structure of the string bearing in FIG. 1.

In a preferred embodiment shown in FIG. 1 and FIG. 7, the TC bearings 3 are respectively near the two ends of the string bearing 17. The TC bearing moving-ring 31, connected with the mandrel 4 by a threaded connector, limits the axial displacement of the string bearing inner ring 173 coupled with the mandrel 4, and TC bearing static ring 32, connected with the upper shell 9 or the main body 12 by a threaded connector, limits the axial displacement of the string bearing outer ring 171. The retaining ring A 6 of the string bearing 17 simultaneously limits the axial position of the string bearing outer ring 171 and the centralizing bearing outer ring 81, and the string bearing outer ring 171 is connected with the upper shell 9 or the main body 12.

In above embodiments, the string bearing 17 can realize the separation of rotation speed of the mandrel 4 from the upper shell 9 and the main body 12 in the above setting mode to isolate the influence of the mandrel 4 on the upper shell 9 and the main body 12 so that they can keep relatively static or slow rotation in the well. The radial reaction force generated during the deviation correction is transferred from the TC bearing 3 to the mandrel 4, then the lateral force is transferred to the bit.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology. The present invention is not limited to the specific embodiments disclosed herein, but includes all technical solutions falling within the scope of the claims.

What is claimed is:

1. A mechanical automatic vertical drilling tool, comprising: a test member, a mandrel, a control device, an actuator, a main body, an auxiliary part, and first and second ends, the first end being connectable by a first detachable screw thread, and the second end being connectable by a second detachable screw thread; wherein:

the test member functions as an upper connector of the mechanical automatic vertical drilling tool, is configured to test an azimuth angle, a tool face angle, and a well inclination angle, and the test member has an inner part connected with the mandrel;

the control device comprises an eccentric block switch inside an upper shell and a plane bearing and a centralizing bearing configured to limit axial and radial movement of the eccentric block switch; the control device is configured to automatically detect and control an operation of the actuator;

the actuator includes a plurality of unidirectional nozzles, a plurality of first pushing blocks and a second pushing block each having a clearance fit of the main body, and pushing block screws on the plurality of first pushing blocks; the actuator being configured to generate a radial force to correct a deviation when the mechanical automatic vertical drilling tool is tilted; and the auxiliary part comprises a lower connector, string bearings that withstand an axial force of the control device, and a tungsten carbide (TC) bearing that withstands the radial force.

2. The mechanical automatic vertical drilling tool as in claim 1, wherein the eccentric block switch comprises an eccentric block and a switch, is in the upper shell supported by the plane bearing and the centralizing bearing, and is configured to rotate freely relative to the mandrel and the upper shell.

3. The mechanical automatic vertical drilling tool as in claim 2, wherein the eccentric block has one side relative to a centerline of the eccentric block switch that is a complete half cylinder, and another side that is at least partially removed so that the one side and the other side are asymmetric; the eccentric block has upper and lower ends configured with shoulders for assembling the centralizing bearing and the plane bearing, respectively; the switch is configured with a third hole and a fourth hole on opposite sides of the complete half cylinder, and grooves around the third hole and the fourth hole for a sealing ring on an outer surface of the switch.

4. The mechanical automatic vertical drilling tool as in claim 1, wherein the plurality of first pushing blocks and the second pushing block each have a 'C' shape, the main body matches with a clearance fit in an internal portion of the plurality of first pushing blocks and an internal portion of the second pushing block.

5. The mechanical automatic vertical drilling tool as in claim 4, wherein the plurality of first pushing blocks are configured with six pushing block screws, and the second pushing block includes six corresponding grooves; and the pushing block screws fit with the grooves to limit radial expansion and contraction of the plurality of first pushing blocks and the second pushing block.

6. The mechanical automatic vertical drilling tool as in claim 4, wherein the plurality of first pushing blocks and the second pushing block are radially distributed in two layers in a radial direction of the main body, horizontally perpendicular to each other.

7. The mechanical automatic vertical drilling tool as in claim 6, wherein the main body is connected with the upper shell and includes first and second cavities for the plurality of first pushing blocks and the second pushing block; the main body has a surface opposite to the unidirectional nozzles that is configured with symmetrical fifth holes; and at least one of the fifth holes has an axis that is perpendicular to another one of the fifth holes.

8. The mechanical automatic vertical drilling tool as in claim 4, wherein the unidirectional nozzles each have a shell that is connected with the plurality of first pushing blocks or the second pushing block; the shell has (i) an internal portion with a threaded connection mechanism (ii) and an inner baffle, the internal portion of the shell is connected to the inner baffle, and another portion of the shell comprises an internal spline groove; the unidirectional nozzles each have a valve with a spool having an outer diameter; the shell has a minimum inner diameter identical to an outer diameter of the valve; the inner baffle has an inner hexagonal through hole with an inner diameter that is less than the outer diameter of the spool; and the unidirectional nozzle only allows fluid to flow in one direction.

9. The mechanical automatic vertical drilling tool as in claim 1, wherein the mandrel has a first hole and a second hole; each of the first hole and the second hole has an axis and at least one of the first hole and the second hole corresponds to fifth holes on the main body; the mandrel has an outer surface configured with annular grooves near the first hole and the second hole; the mandrel has upper and lower ends respectively connected with the test member and the lower connector by threaded connectors.

10. The mechanical automatic vertical drilling tool as in claim 1, wherein the tungsten carbide (TC) bearing is near the string bearings; the mandrel is connected to a tungsten carbide (TC) bearing moving-ring, and the upper shell or the main body is connected to a tungsten carbide (TC) bearing static ring; the TC bearing moving-ring and the TC bearing static ring limit an axial displacement of a string bearing inner ring connected with the mandrel and a string bearing outer ring connected with the upper shell and the main body; and a first retaining ring of the string bearings simultaneously limits an axial position of the string bearing outer ring and an outer ring of the centralizing bearing.

* * * * *